US005963999A

United States Patent [19]

Gardiner et al.

[11] Patent Number: 5,963,999

[45] Date of Patent: Oct. 12, 1999

[54] MULTI-PURPOSE FOLDING TOOL

[75] Inventors: Walter A. Gardiner, Waccabuc; David A. Swinden; James Quinn, both of Ellenville; Robert Andersen, Cragsmoor; Oleh Stecyk, Kerhonkson, all of N.Y.; Joseph A. Hufnagel, Bethel, Conn.; Peter F. Lynch, Skaneateles, N.Y.; David A. Furth, Skaneateles, N.Y.; Robert L. Naas, Skaneateles, N.Y.

[73] Assignee: Imperial Schrade Corp., Ellenville, N.Y.

[21] Appl. No.: 09/099,367

[22] Filed: Jun. 18, 1998

Related U.S. Application Data

[63] Continuation of application No. 08/724,963, Oct. 7, 1996, Pat. No. 5,791,002.

[51] Int. Cl.[6] ..... B25B 7/22

[52] U.S. Cl. ..... 7/128; 7/129; 76/114; 76/DIG. 6; 81/427.5; 81/177.4; 81/177.6

[58] Field of Search ..... 81/427.5, 424.5, 81/418, 177.4, 177.6, 407; 7/128, 127, 129; 76/114, DIG. 6

[56] References Cited

U.S. PATENT DOCUMENTS

| | | |
|---|---|---|
| 97,154 | 11/1869 | Barnard et al. . |
| 234,378 | 11/1880 | Pierce . |
| 288,397 | 11/1883 | Barr . |
| D. 368,634 | 4/1996 | Frazer . |
| D. 371,498 | 7/1996 | Lai . |
| D. 382,182 | 8/1997 | Seber et al. . |
| D. 384,872 | 10/1997 | Yeh . |
| D. 401,133 | 11/1998 | Gardiner . |
| 526,480 | 9/1894 | Bernard . |
| 649,334 | 5/1900 | Meloos . |
| 831,676 | 9/1906 | McLeran . |
| 858,003 | 6/1907 | Klever . |
| 1,174,132 | 3/1916 | Dragun . |
| 1,334,425 | 3/1920 | Wernimont . |
| 1,461,270 | 7/1923 | Garrison . |
| 1,467,661 | 9/1923 | Undy . |
| 1,474,592 | 11/1923 | Jacoby . |
| 1,524,694 | 2/1925 | Maio . |
| 2,575,652 | 11/1951 | Bovee . |
| 2,720,799 | 10/1955 | Pfost . |
| 2,753,741 | 7/1956 | Riley . |
| 3,044,081 | 7/1962 | Robinson, Jr. . |
| 4,238,862 | 12/1980 | Leatherman . |
| 4,502,220 | 3/1985 | Aoki . |
| 4,512,051 | 4/1985 | Magan . |
| 4,648,145 | 3/1987 | Miceli . |
| 4,660,241 | 4/1987 | Chen et al. . |
| 4,662,252 | 5/1987 | Warheit . |
| 4,744,272 | 5/1988 | Leatherman . |
| 4,888,869 | 12/1989 | Leatherman . |
| 5,062,173 | 11/1991 | Collins et al. . |
| 5,142,721 | 9/1992 | Sessions et al. . |
| 5,212,844 | 5/1993 | Sessions et al. . |
| 5,267,366 | 12/1993 | Frazer . |
| 5,351,584 | 10/1994 | Warheit . |
| 5,491,856 | 2/1996 | Legg . |
| 5,526,571 | 6/1996 | Lindén . |

FOREIGN PATENT DOCUMENTS

| | | |
|---|---|---|
| 0513937A2 | 11/1992 | European Pat. Off. . |
| 30788 | 3/1885 | Germany . |

OTHER PUBLICATIONS

Gerber Tool, in public use before Oct. 7, 1996.
American Camper Tool, in public use before Oct. 7, 1996.
Buck Knives "BuckTool" advertisement, published before Oct. 7, 1996.

(List continued on next page.)

*Primary Examiner*—D. S. Meislin
*Attorney, Agent, or Firm*—Saidman DesignLaw Group

[57] ABSTRACT

A multi-purpose folding tool which features inwardly tapered handles to provide external plier jaw storage, thereby leaving greater room for supplemental tool storage inside the handles, a box-beam handle construction for greater strength, downwardly opening handles to facilitate ease of use, a unique supplemental tool locking and release mechanism, and laminated plier jaws which are riveted together for even greater strength and overall integrity.

54 Claims, 15 Drawing Sheets

OTHER PUBLICATIONS

"BuckTool, Blitz and Big Nut Bust Out!", story about "BuckTool", *Blade*, Jul. '96, pp. 52, 54.

Leatherman Pocket Survival Tool II (PST II™) Product Description, issued before Oct. 7, 1996.

Leatherman Tool (the original) Product Description, issued before Oct. 7, 1996.

Leatherman Super Tool Product Description, issued before Oct. 7, 1996.

Leatherman Pocket Crimper Survival Tool Product Description, issued before Oct. 7, 1996.

Leatherman Pocket Survival Tool™ Product Description, issued before Oct. 7, 1996.

Gerber Multi–Plier™ Tool (MPT) Product Description, Item Nos. 55800, 55850, 55860, 55890, 50002, 50003, 50004, 55782, and 55200, issued before Oct. 7, 1996.

Gerber Military Provisional Tool (MPT) Product Description, Item Nos. 55511 and 55721, issued before Oct. 7, 1996.

Yorkcraft Road Warrior Tool Product Description, issued before Oct. 7, 1996.

Coast Pliers + Plus™ Product Description, Item No. C201000, issued before Oct. 7, 1996.

Bear MGC Cutlery Bear Jaws Product Description, issued before Oct. 7, 1996.

Generic Multi Function Pocket Tool Product Description, issued before Oct. 7, 1996.

MULTI-PURPOSE FOLDING TOOL

CROSS-REFERENCE TO RELATED APPLICATION

This application is a continuation of our prior application Ser. No. 08/724,963, filed Oct. 7, 1996, now U.S. Pat. No. 5,791,002 issued Aug. 11, 1998.

BACKGROUND OF THE INVENTION

1. Field of The Invention

This invention relates to a multi-purpose folding tool, commonly referred to as a compound or combination tool, since it includes a plurality of independently used tools, or as a survival tool, since it has rapidly become the tool of choice of outdoorsmen. A typical compound tool may incorporate pliers, flat-head and Phillips-head screwdrivers, knife blades, an awl, a pick, a fish cleaning serrated blade, a ruler, a wire insulation trimmer, and a bottle/can opener. Each of these independently used tools are typically housed in a single tool capable of folding into an easily carried, compact unit. Compound tools of this type are especially useful to those who need to maximize the utility of what they carry while minimizing the size and weight thereof, e.g. backpackers, bikers, campers, electricians, fishermen, hikers, and hunters.

2. Description of Related Art

Combination tools, i.e., those in which several different types of tools, e.g., a knife blade, an awl, or an assortment of screwdrivers and wrenches, are individually rotatable into and out of a housing for storage and use, respectively, have been the subject of U.S. patents for some time; see, for example, Barnard & Brace, U.S. Pat. No. 97,154, issued Nov. 23, 1869, and Pierce, U.S. Pat. No. 234,378, issued Nov. 8, 1880. Combination tools which include a pair of scissors or pliers, in which the crossed jaws fold into or adjacent to their handles, were developed around the turn of the twentieth century; see, respectively, Klever, Kaiserliches Patentamt, Patentschrift No. 30,788, issued Mar. 12, 1885, and Klever, U.S. Pat. No. 858,003, issued Jun. 25, 1907. The latter allows other tools, e.g., a knife blade, to be joined therewith, although the other tools are stored separately from the folded tool by inserting their base into a notch formed by the closed handles. Pliers having handles pivotally connected to the tangs of the pliers jaws, such that the handles fold adjacent the pliers jaws, are also known (e.g., Garrison, U.S. Pat. No. 1,461,270).

Combination tools including folding pliers in combination with other, supplemental tools, usually stored within the handles, the so called "survival tools", did not achieve widespread popularity until relatively recently with the patenting of such tools by Leatherman, U.S. Pat. Nos. 4,238,862, 4,744,272, and 4,888,869, and as evidenced in European Patent Application No. 513,937. Others followed quickly, e.g., Collins et al., U.S. Pat. Nos. Des. 368,634, and 5,062,173, Sessions et al., U.S. Pat. Nos. 5,142,721 and 5,212,844, and Frazer, U.S. Pat. Nos. Des. 368,634, and 5,267,366. All of these prior art tools are generally satisfactory for their intended purposes, but they do have drawbacks associated therewith.

In all of the folding tools cited above, from Klever to Frazer, the folding tools include straight handles. Thus, when the folding tool is closed, the jaws of the pliers are stored within the confines of the handles. Not only are the handles weakened by removing portions of the walls of the handles to receive the pliers, the space inside the handles is diminished, thereby decreasing the room available for the supplemental tools, which must perforce be made smaller and weaker.

Many folding tools position the plier head over some of the supplemental tools when completely closed. It is then necessary to go to the inconvenience of opening the plier portion of the tool when desiring only to access a supplemental tool. This then requires fully closing the plier portion of the tool again before you can actually use the supplemental tool.

The handles of Leatherman, Collins et al., Sessions et al., and Frazer are channel-shaped, open along their entire length, which may make them more susceptible to bending under heavy strains, particularly near the pivotal connection of the handles with the plier jaws' tangs, depending upon the thickness of the material.

The channel openings of Leatherman and Frazer (Design Patent No. 368,634) open outwardly along the outer edge of the handles, i.e., outwardly in the plane of the handles. When squeezing the handles, the open channels and supplemental tools therein present rough surfaces and raw edges to the hands.

Prior art survival tools latch or lock the supplemental tools in their stored and extended positions by means of either (1) a leaf spring coacting with a flat on the periphery of the supplemental tools (e.g., Leatherman, Collins et al., Sessions et al., and Frazer), or by providing a projection at the end of the leaf spring to mate with a recess or notch in the periphery of the supplemental tools (Leatherman). The latter is the time-honored method used in related arts as well, such as, in jack-knives, vanity kits, or other specialized combination tools; see Hallvarson, 1,556,788, Nielsen, 1,561,993, Bovee, 2,575,652, Bassett, 2,798,290, Zoeller, 2,851,704, and Felix-Dalichow, 4,442,600. In each of these, a projection on a separate lever or spring, or a flange on a resilient portion of the housing, fits into a notch on the supplemental tool to lock the tool in place. Alternatively, a projection on the tool mates with a seat or notch on the housing. Either way, a projection is designed to mate with a notch. Projections or flanges are difficult and costly to manufacture, and notching a tool to receive the projection usually results in lost material, and thereby lost strength, in the mounting end of the tool.

Though supplemental tools may lock in extended position to some degree, many tools have little or no provision for a completely positive lock. One reason is the resulting problem of providing an unlocking means that is safe, convenient and cost effective. With supplemental tools locking in a less than completely sure manner in the extended position, safe use can be questionable.

The jaws of pliers, wrenches, etc., have in the past occasionally been of a laminated construction, i.e., a plurality of sheets bound together by some means, often by rivets; see, e.g., Bernard, 526,480, McLeran, 831,676, Chen et al., 4,660,241, and Warheit, 4,662,252. In each of these, the laminations reinforce each other against forces acting transversely to the jaws, but they provide little to no resistance to shearing forces along the planar surfaces between the laminates.

OBJECTS AND SUMMARY OF THE INVENTION

The present invention overcomes the difficulties described above by:

tapering the handles inwardly to create recesses which, when the tool is folded, provides storage for the plier jaws, maintaining the integrity and strength of the handle walls while providing more room for larger, heftier supplemental tools;

reinforcing the handles with a box-beam construction in the area of the handle-to-tang pivots;

opening the channels in a direction away from the palm of the hand when the plier is operational, so that the user's hand squeezes on relatively smooth handle surfaces;

forming a stock on the end of a leaf spring to mate with a notch in the mounting end of the supplemental tool to lock it in place;

interlocking the laminates of plier jaws against shear forces along their planar surfaces by providing mating countersinks and daps in their facing surfaces;

storing supplemental tools outside the closed plier handles for quick, safe and convenient access; and providing a lock release mechanism that conveniently works with a completely positive locking design for the supplemental tools.

Accordingly, it is one object of the present invention to taper inwardly the folding handles of a multi-purpose folding tool, making the pair of handles more comfortable while in the process creating a recess which, when the tool is folded, stores the plier jaws externally of the handle walls.

Another object of the present invention is to reinforce the handles by providing a box-beam construction adjacent the pivotal connections with the folding pliers.

A further object of the present invention is to provide smooth, comfortable handle surfaces for contact with the user's hands when the tool is in use.

A still additional object of the present invention is to provide a stock on a flange-less leaf spring to mate with a small notch on the mounting end of the tool to lock the tool in place.

Another object of the invention is to provide a stronger jaw structure for a gripping tool, e.g., a pair of pliers, by including complementary, mating countersinks and daps in the laminates, thereby constraining the laminates against lateral shifting.

The foregoing and other objects are achieved in accordance with one aspect of the present invention through the provision of a multi-purpose folding tool which comprises a pliers having a pair of crossed jaws. Each of the jaws includes a gripping end with a tip, a pivot bearing, and a tang. The jaws are rotatably connected to each other by a jaw pivot pin extending through each of the pivot bearings.

The folding tool further includes a pair of handles each having a secured end and a free end. A pivot bearing is located at the secured end of each handle and is rotatably connected to one of the tangs by a pivot pin. The axes of the jaw pivot pin and the tang pivot pins are substantially parallel to one another. The handles each further include a pair of upstanding sidewalls integrally connected by a web, the sidewalls and the web forming a U-shaped channel open outwardly from the plane of the handles.

The pair of sidewalls comprise an outboard sidewall facing away from the opposite handle and an inboard sidewall facing toward the opposite handle, each of the outboard sidewalls of the handles including an inwardly tapered portion to define a recess adjacent to a respective one of the pivot bearings.

The handles also include a channel pivot pin journaled in the sidewalls transverse of the channel adjacent the free end of the handle. The axis of the channel pivot pin is substantially orthogonal to the axes of the jaw and tang pivot pins.

A plurality of supplemental tools are pivotally mounted on the channel pivot pin. Each of the supplemental tools is individually rotatable between a closed position within the channel and an open position extending from the channel.

The inwardly tapered portions of the outboard sidewalls are configured such that when the folding tool is folded by pivoting the handles about the tang pivot pins, the inwardly tapered portions of the outboard sidewalls cam the tips of the jaws towards one another to assist in the folding of the multi-purpose folding tool.

In addition, when the folding tool is folded, the outboard sidewalls enclose the jaws between the recesses. The inboard sidewalls may include a second tapered portion to provide a separation between the free ends of the handles, while the outboard sidewalls preferably include protrusions or nubs formed thereon to improve the grip of a user's thumb and fingers on the folding tool.

In accordance with another aspect of the present invention, the web includes a flat, resilient leaf spring located at one end of the channel, and a slot through the free end of the leaf spring. The slot is bordered across the free end by a transverse, flat, flange-free stock. Each of the supplemental tools comprises a body and a mounting end, the body being shaped as appropriate for the function of the supplemental tool. The mounting end is pivotally mounted on the channel pivot pin. At least one of the supplemental tools includes a mounting end having a peripheral notch positioned to snugly receive the stock therein, when such supplemental tool is extended, to positively lock same.

In accordance with another aspect of the present invention, release means are provided for unlocking such supplemental tool from its extended, locked position. The release means preferably comprises an outwardly directed bulge positioned on another of the supplemental tools on the body thereof. The bulge protrudes above the longitudinal edges of the sidewalls when its supplemental tool is closed. The mounting end of such supplemental tool is configured such that depression of the bulge causes the mounting end to deflect the leaf spring, lifting the stock out of the notch. In addition, the mounting end of such supplemental tool includes a peripheral flat which coacts with the leaf spring to bias such supplemental tool closed. Such flat has a corner which contacts and deflects the leaf spring when the bulge is depressed.

Another of the supplemental tools includes a mounting end having first and second peripheral flats. The first flat coacts with the flat leaf spring to bias such supplemental tool into its closed position, while the second flat coacts with the leaf spring to bias such supplemental tool into its open position, thereby retaining such supplemental tool in its closed and open positions, respectively.

In accordance with yet another aspect of the present invention, each of the pair of jaws preferably comprises at least three laminated sheets. Each pair of adjacent sheets is preferably reinforced with at least one mating countersink and dap. Binding means, preferably in the form of a rivet, passes through the laminated sheets to secure them together. The laminated sheets preferably comprise a central body and a pair of outer strips. The countersinks are preferably formed in the central body while the daps are preferably formed in the outer strips.

In accordance with another aspect of the present invention, the handles further include a fourth wall folded over a portion of the outward opening of the U-shaped channel so as to form a box-beam construction. One of the walls of the box-beam construction further may include an aperture therethrough which is adapted to receive a lanyard.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
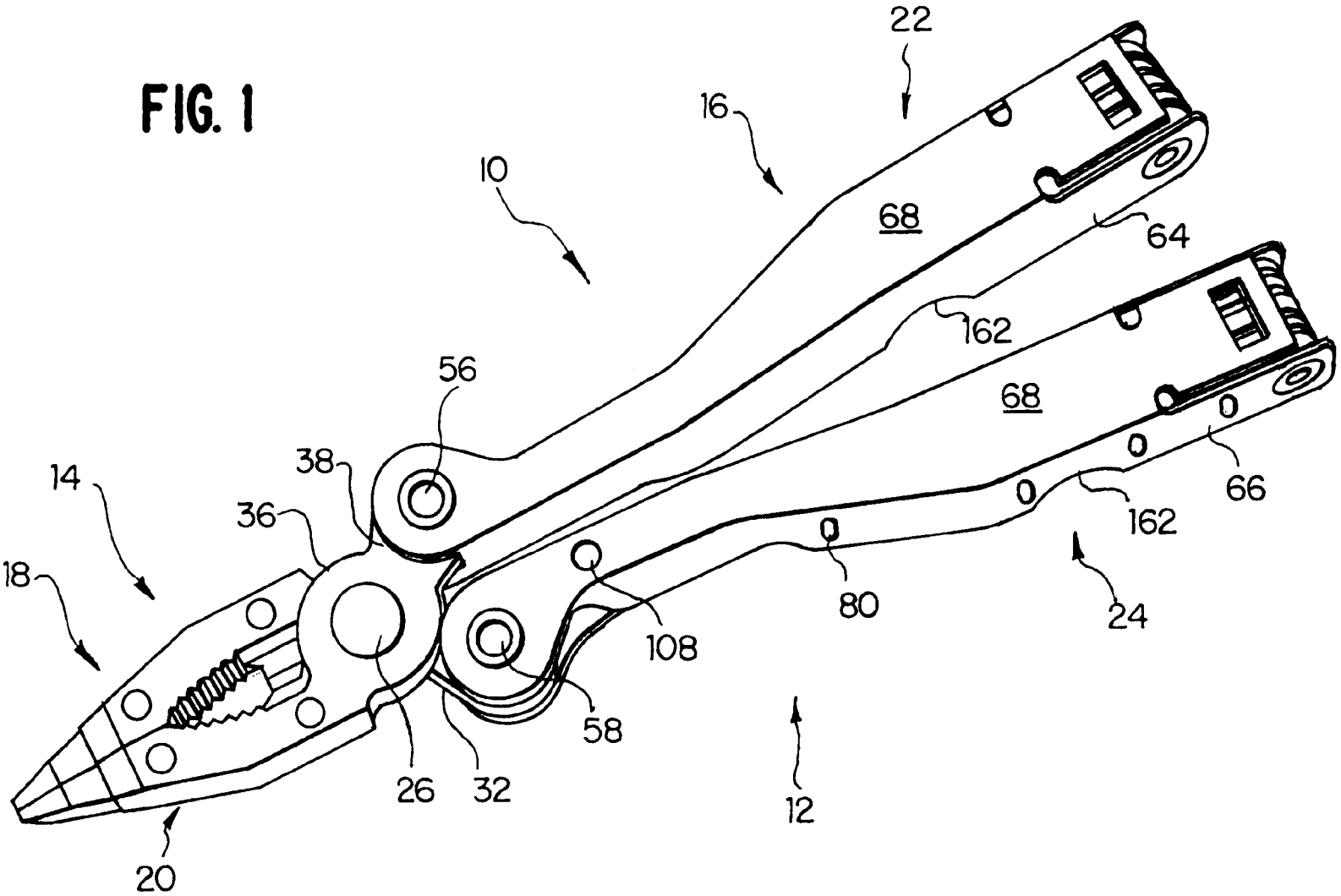
FIG. 1 is a top perspective view which shows the preferred embodiment of the present invention as it appears when opened with the plier jaws closed.
Figure 6:
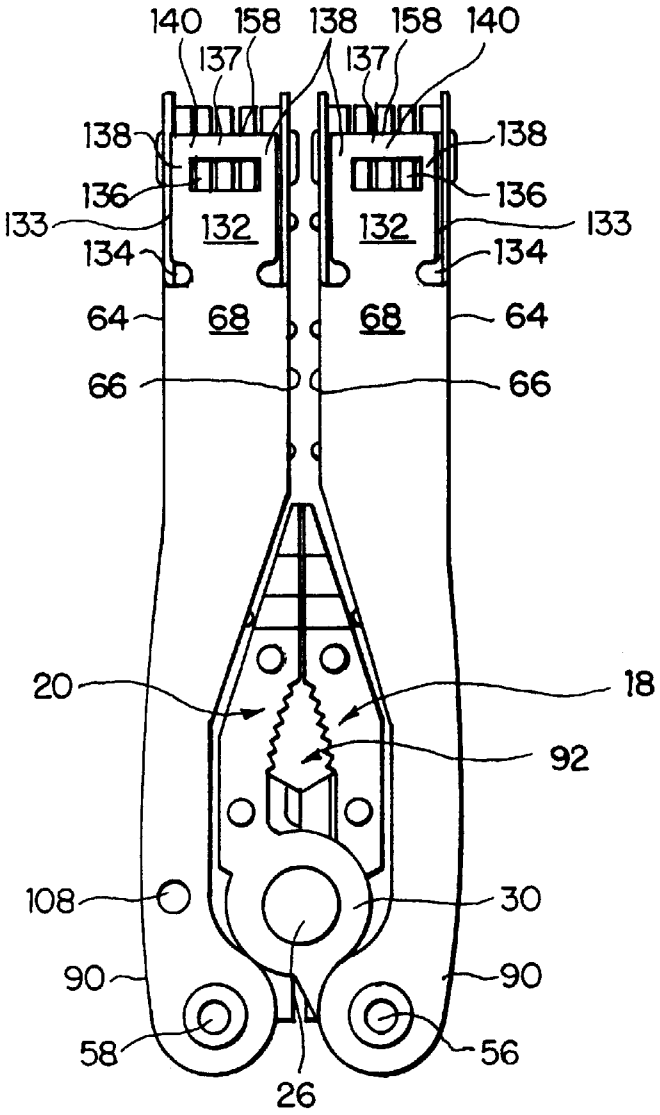
FIG. 6 is a top view of the closed compound tool.

A preferred embodiment of a multi-purpose folding tool, combination tool, or compound tool of the present invention is indicated generally by reference numeral 10 and is seen in its opened or unfoled state in FIG. 1 and its closed or folded state in FIG. 6. When opened, it has the overall form of a pair of pliers. When closed, tool 10 is box-shaped and occupies a relatively small amount of space with relatively smooth external surfaces.

For the sake of clarity in the drawings, the reference numerals in FIGS. 1–6 have been placed on a figure only if a particular feature is most clearly shown in that figure. In other words, including reference numerals for all of the features shown in each figure has been avoided in the interest of clarity.

In FIG. 1, compound tool 10 is shown in the form of a cross-jawed pliers 12 comprising a gripping end 14 and a handle end 16. Gripping end 14 includes a pair of plier jaws 18 and 20; handle end 16 includes a pair of handles 22 and 24. Pliers 12 are cross-jawed pliers inasmuch as jaw 18 is connected across a pivot pin 26 to handle 24 and jaw 20 is connected across pivot pin 26 to handle 22. Pliers 12 preferably comprise needlenose pliers, and, while this is the preferred embodiment, any other plier shape could be substituted.

Figure 4:
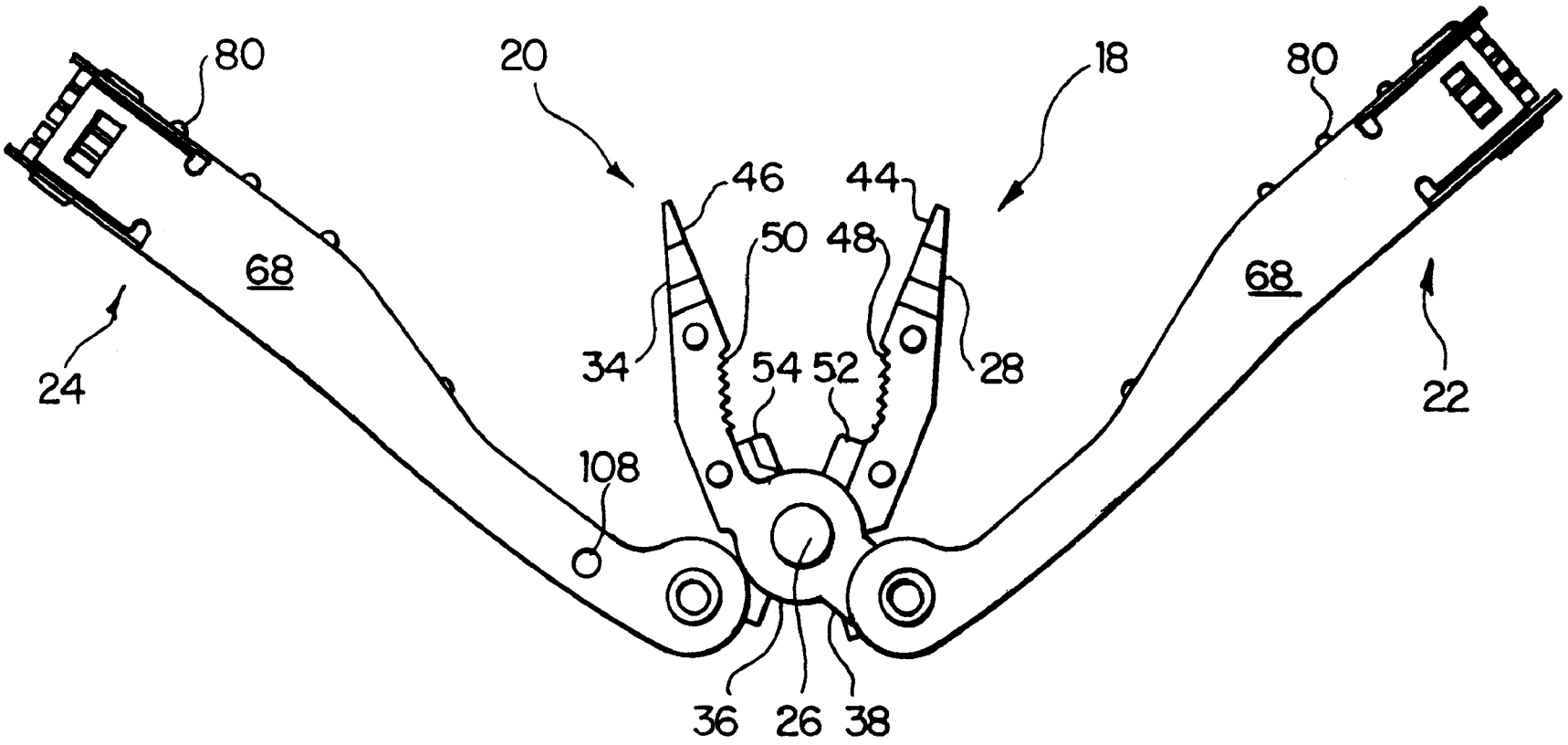
FIG. 4 is a top view of the compound tool partially closed.
Figure 12:
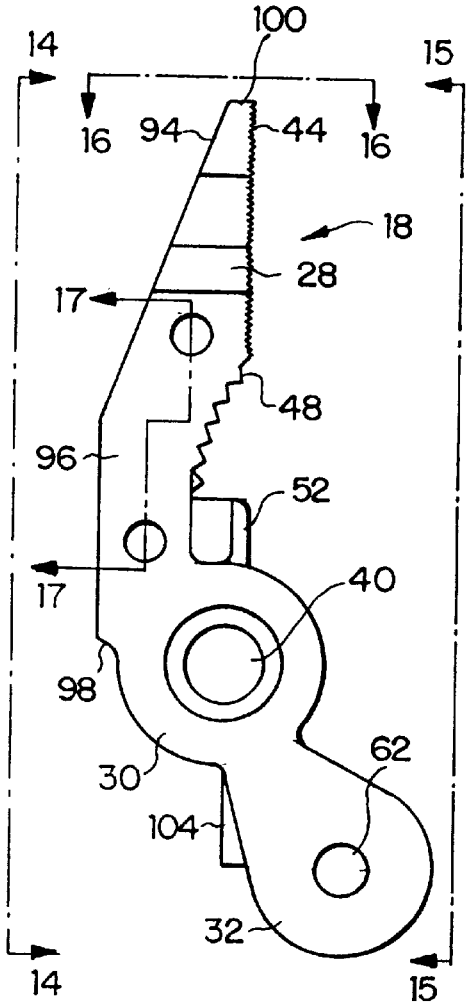
FIGS. 12 and 13 show side views of the two plier jaws separated and facing one another.
Figure 13:
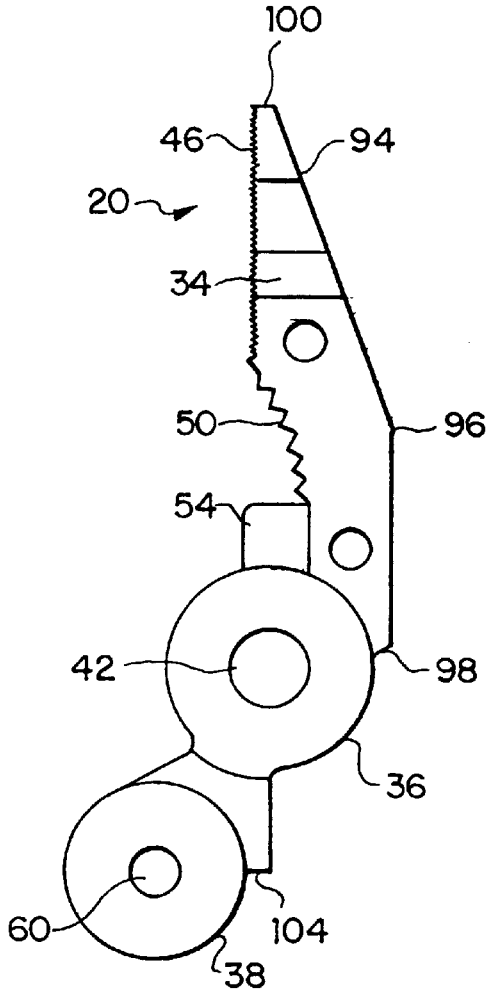

As seen in FIGS. 4, 12, and 13, jaw 18 is functionally divided into a nose 28, a bearing 30, and a tang 32. jaw 20 is preferably although not necessarily a mirror image of jaw 18 and also comprises a nose 34, a bearing 36, and a tang 38. jaw 18 and jaw 20 are rotationally joined together by aligning apertures 40 and 42 in bearings 30 and 36, respectively, and extending pivot pin 26 therethrough (FIGS. 1 and 4). Jaws 18 and 20 present opposing, generally flat surfaces 44 and 46 for gripping flat objects, arcuate surfaces 48 and 50 for gripping round, square, or hexagonally shaped objects, and cutting surfaces 52 and 54 for cutting materials such as wire, all as is well known in the art. Surfaces 44–50 may be serrated as desired to improve their gripping abilities. The remaining features of jaws 18 and 20 will be introduced as they arise in the following description of the invention.

Returning to FIG. 1, handle 22 is pivotally attached to tang 38 of jaw 20 by a pivot pin 56, while handle 24 is pivotally attached to tang 32 of jaw 18 by a pivot pin 58. Pins 56 and 58 extend through a pair of apertures 60 and 62, respectively, formed in tangs 38 and 32 (FIGS. 12-13).

Pivot pins 26, 56, and 58 are parallel and extend generally outwardly from the plane of the drawings, providing rotational movement thereabout in the plane of the drawings. This is an important feature for it provides the pliers 12 of the present invention with more structural stability than prior art compound tools in which the plier jaws fold into the handles along axes perpendicular to the plier's pivot, such as found in Collins et al., U.S. Pat. No. 5,062,173, and Frazer, U.S. Pat. No 5,267,366.

Figure 2:
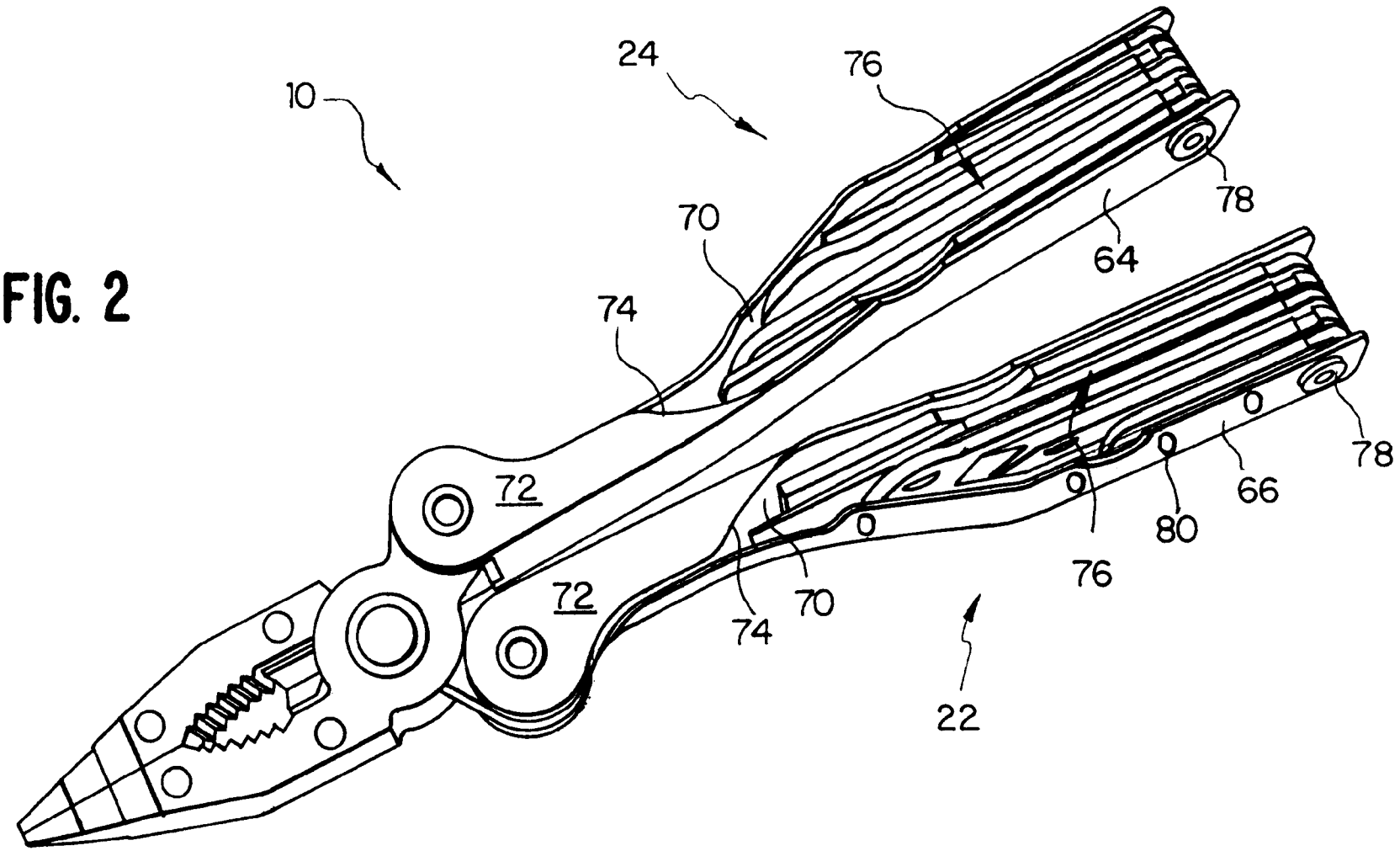
FIG. 2 is a bottom perspective view of the opened inventive tool with the plier jaws closed.

The structure of handles 22 and 24 are best seen in the perspective views of FIGS. 1 and 2 to which attention is now directed. Common features in each handle will be given the same reference numeral for simplicity and clarity of description.

Handles 22 and 24 are channel shaped with each handle being formed by a pair of upstanding sidewalls, namely by an interior sidewall 64 and an exterior sidewall or outboard wall 66, which are connected by a web 68. ("interior" and "exterior" are relative terms and are used here with reference to the views in FIGS. 1–3, where compound tool 10 is shown in its opened state. In the closed state of FIGS. 4–6, the relationship between "exterior" and "interior" obviously reverses.) Sidewalls 64 and 66 and web 68 define an internal channel 70 partially open toward the bottom of tool 10, as seen in FIG. 2. A partial web 72 (FIG. 2) is folded and extends integrally from the pivot end of sidewall 64 towards the pivot end of sidewall 66, thereby effectively enclosing the pivot end of channel 70 in a box-beam construction which further strengthens the handles 22 and 24 of pliers 12. The sloped edges 74 of partial webs 72 increase the torsional strength of handles 22 and 24.

Prior art compound tools which also include channel-shaped handles for housing supplemental tools, such as Leatherman, (U.S. Pat. Nos. 4,238,862, 4,744,272, and 4,888,869), European Patent Application 513,937, Collins et al. (U.S. Pat. Nos. Des. 368,634 and 5,062,173), Sessions et al. (U.S. Pat. Nos. 5,142,721 and 5,212,844), and Frazer (U.S. Pat. Nos. Des. 368,634 and 5,267,366), show U-shaped channels throughout the length of their handles. Since the foregoing do not have the enclosed, box beam construction of the handles of the present invention, they lack the torsional resistance required when twisting pliers 12 against a heavy load.

Channel 70 houses a plurality of supplemental tools 76 (FIG. 2) which may be stored therein and retrieved therefrom. More particularly, sidewalls 64 and 66 and webs 68 and 72 leave an opening to channel 70 through which supplemental tools 76 may be rotated about a pair of pivot pins 78 (that extend between the ends of sidewalls 64 and 66) from their stored positions shown in FIG. 2 to their extended positions, some of which are shown, for example, in FIGS. 8A and 9–11.

As seen in FIG. 2, channel 70 opens toward the bottom of tool 10, in contrast to the side tool openings shown in so many of the prior art compound tools mentioned above, so supplemental tools 76 of the present invention are facing away from the palm of the hand when pliers 12 are being used. Sidewalls 64 and 66 and webs 68 of handles 22 and 24 are solid sheets, so that there are no rough surfaces or standing handle edges to cause discomfort to one's hand when squeezing handle end 16 of the present invention. A plurality of raised, rounded nubs 80 or various other configurations may be added to exterior sidewalls 66 to improve the user's grip on handles 22 and 24 without adding potentially painful sharp edges.

Figure 3:
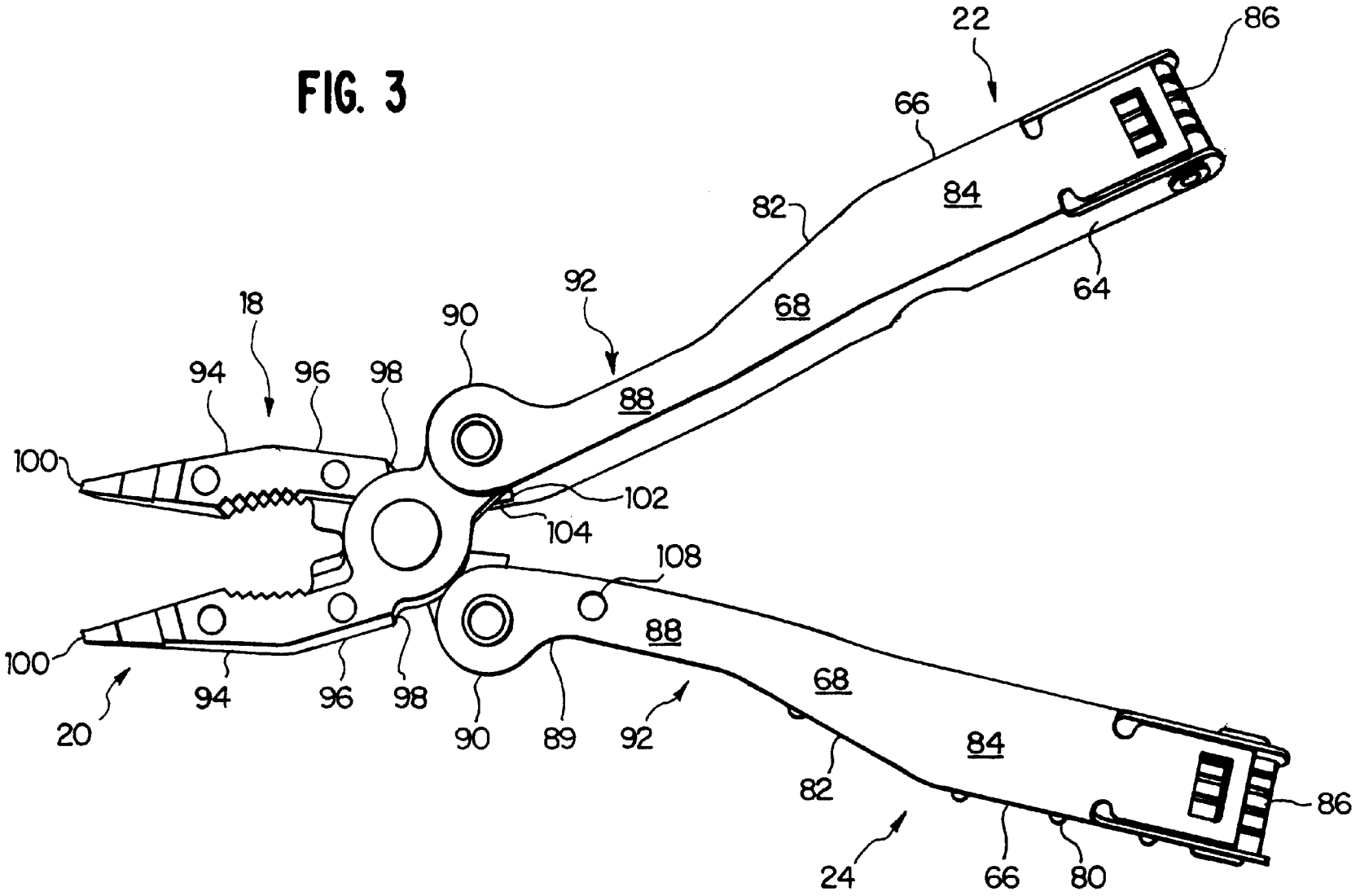
FIG. 3 is a top view of the open compound tool with the plier jaws open.

Referring to FIGS. 3–6, the shape of handles 22 and 24 provides important functional results which distinguishes the present invention from the prior art. More particularly, as seen in FIG. 3, webs 68 of handles 22 and 24 include a tapered portion 82 positioned between two portions having substantially constant widths, namely, a wider end portion 84 adjacent end 86 and a narrower waist portion 88 adjacent pivot bearing 90, to delineate a pair of recesses or jaw recess portions 92 positioned on exterior sidewalls 66.

The disclosed shape allows for many advantages. First, recesses 92 afford a very comfortable nesting area for the thumb and fingers to grip pliers 12. Second, recesses 92 combine to provide an area for storing plier jaws 18 and 20 when compound tool 10 is fully closed, as seen in FIG. 6. Tapered portions 82 are dimensioned and located so as to complement the shape of a pair of tapered portions 94 formed on plier jaws 18 and 20 (FIGS. 3 and 12-13); the smaller, constant width waist portion 88 mates with a pair of flat sides 96 of plier jaws 18 and 20; and the curved portion 89 between waist portion 88 and annular bearing 90 snugly fits around annular bearings 30 and 36. Third, external recesses 92 store gripping end 14 of the pliers 12 externally of the handles' walls, leaving more interior room in the handles for supplemental tools 76. Fourth, storing the gripping end 14 externally of compound tool 10 allows pliers 12 to be used to clamp items, hands-free, for an extended period of time, as will be seen in FIG. 7 to be discussed in greater detail below.

Figure 5:
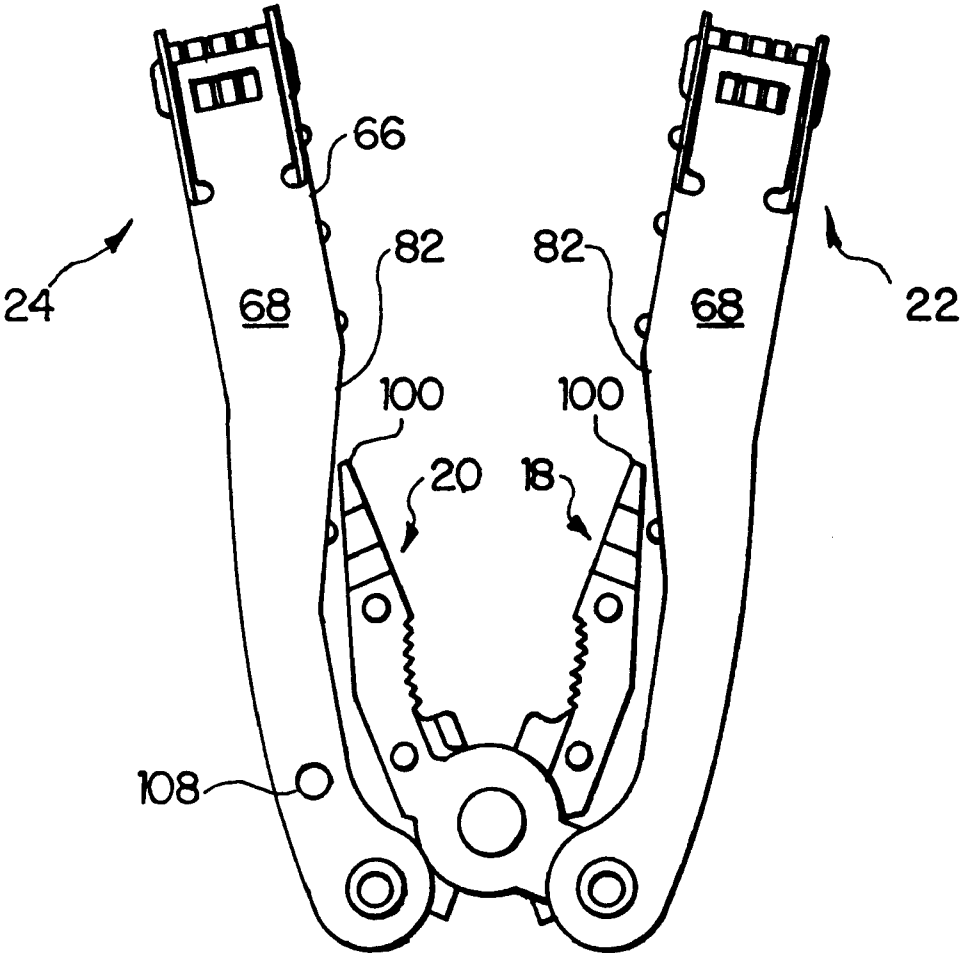
FIG. 5 is a top view of the compound tool almost closed.

FIGS. 3–6 illustrate the manner in which pliers 12 fold into the closed state of compound tool 10. Handles 22 and 24 are pulled apart, as in FIG. 3, until a pair of outer shoulders 98 (FIGS. 3 and 12-13) come into contact with vertical portions of shoulders 104, at which time jaws 18 and 20 cease to diverge. Further outward pressure on handles 22 and 24 overcomes the inherent friction between handles 22 and 24 and tangs 32 and 38, and the plier's handles 22 and 24 begin to converge, as seen in FIG. 4. A pair of tip portions 100 of jaws 18 and 20 are substantially separated from each other in their fully open position, as shown for example in FIGS. 4 and 5. Further movement of handles 22 and 24 towards one another results in the orientation of handles and jaws as shown in FIG. 5. In this orientation, of tips 100 of jaws 18 and 20 contact tapered surfaces or contact portions 82 of exterior (now interior) sidewalls 66 which cam the jaws 18 and 20 together, also forcing tangs 32 and 38 and handle bearings 90 towards one another. Continued pressure brings compound tool 10 finally to the fully closed position shown in FIG. 6. In the latter position, tip portions 100 touch each other.

Referring again to FIGS. 3, 12, and 13, when squeezing pliers 12 together from the FIG. 3 position to seize an object, edges 102 at the pivot end of interior sidewalls 64 adjacent bearings 90 are in contact with shoulders 104 of tangs 32 and 38 (FIGS. 12-13). The forces generated by squeezing handles 22 and 24 are directed from edges 102 through shoulders 104, which, being offset from their pivot pins 26, 56, and 58, applies a force rotating jaws 18 and 20 of pliers 12 together. Each of the interior sidewalls 64 is a relatively planar, solid sheet which is integrally connected with web 68 and sidewall 66. With the force vectors essentially lying within the plane of sidewalls 64, a very stable structure is provided which can withstand high clamping pressures.

Figure 7:
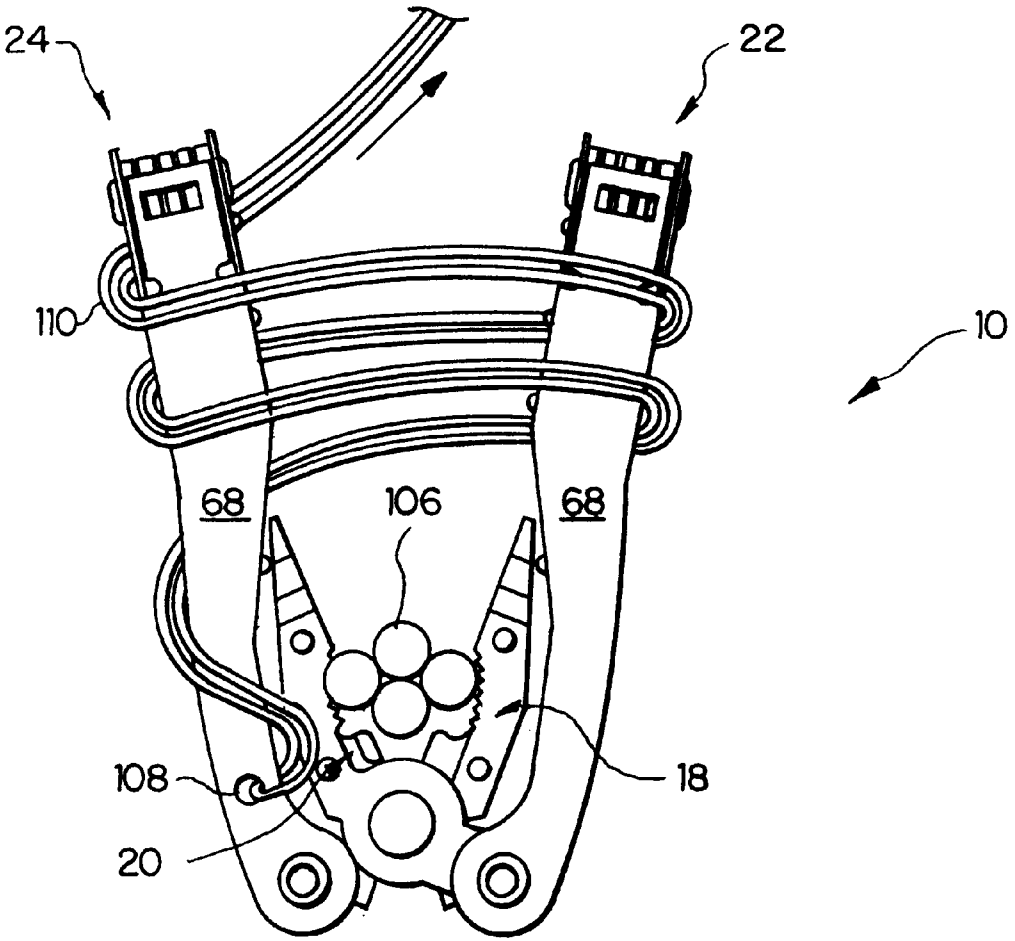
FIG. 7 illustrates a use of the present invention clamping a cable.

One use of tool 10 to clamp items like a vise is shown in FIG. 7. A multi-strand cable 106 is clamped in jaws 18 and 20 with tool 10 in a semi-closed state. An aperture 108 is preferably formed through web 68 of handle 24 and is adapted to receive, when desired, a lanyard 110. Lanyard 110 provides a convenient way to carry tool 10 on a belt or back-pack. It also allows tool 10 to clamp cable 106, or other desired item, by closing tool 10 with cable 106 between the jaws 18 and 20 of pliers 12, and by wrapping lanyard 110 tightly around handles 22 and 24. Tool 10 will continue to clamp cable 106 without the necessity of gripping the pliers in one's hands. As noted above, this advantage is due to the storing of gripping end 14 externally of the handles when tool 10 is closed.

Supplemental tools 76 and their relationship to tool 10 will now be described with reference to FIGS. 8–11.

The selection of which supplemental tools to include in any particular model of tool 10 is discretionary with the manufacturer of tool 10, depending on its intended audience. For example, a fisherman's tool might include supplemental tools useful for fishing, e.g., a serrated blade for cleaning fish, a whetstone for sharpening fish hooks, scissors for cutting line, and an assortment of knife blades, whereas an electrician's tool might include an assortment of screwdrivers, a wire insulation cutter and stripper, a saw, a file, and a ruler. The supplemental tools included in this preferred embodiment are therefore only exemplary of the possibilities.

Figure 10:
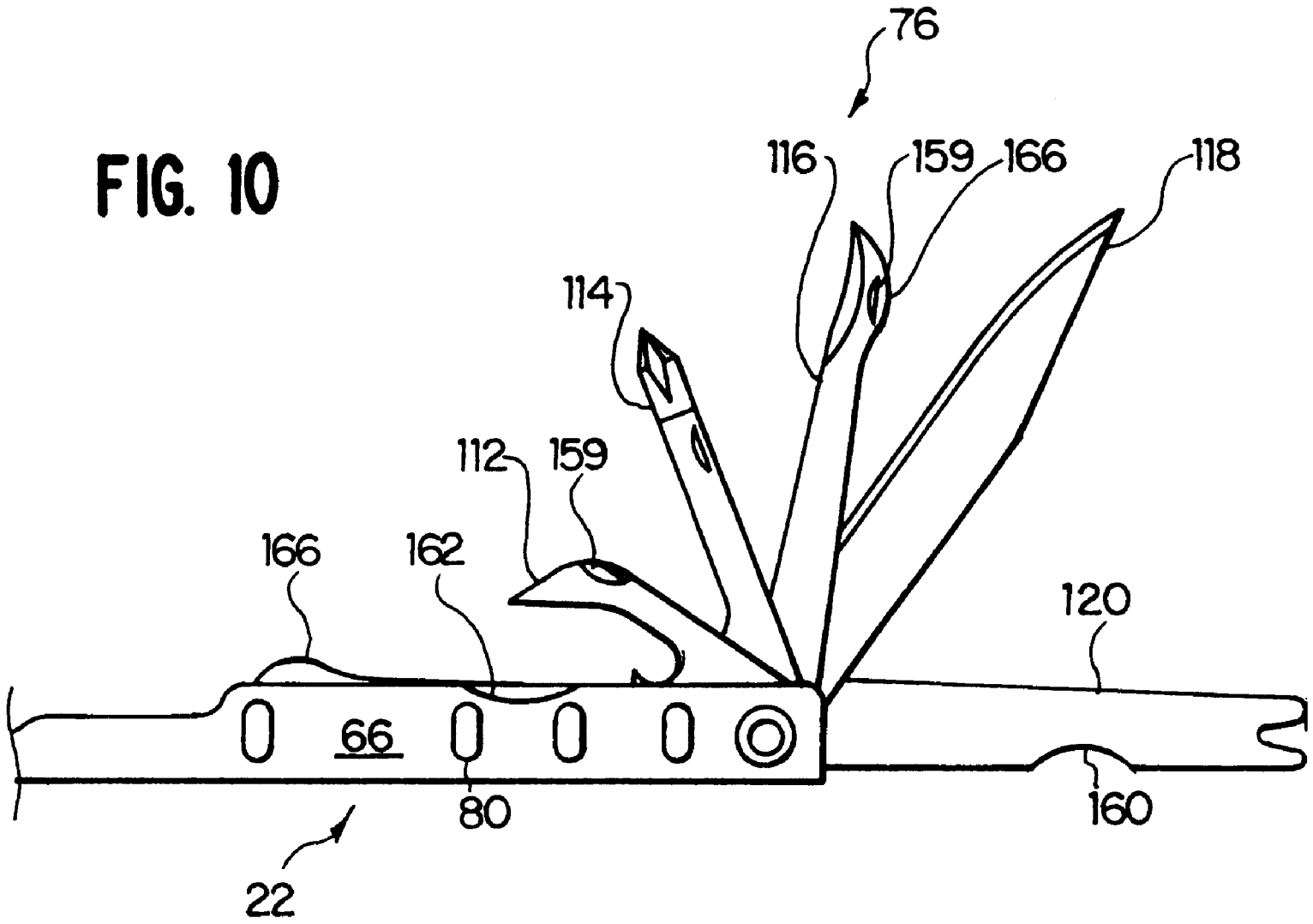
FIG. 10 is a sectional side view of one of the handles of the compound tool with the supplemental tools stored therein in varying degrees of extension.
Figure 11:
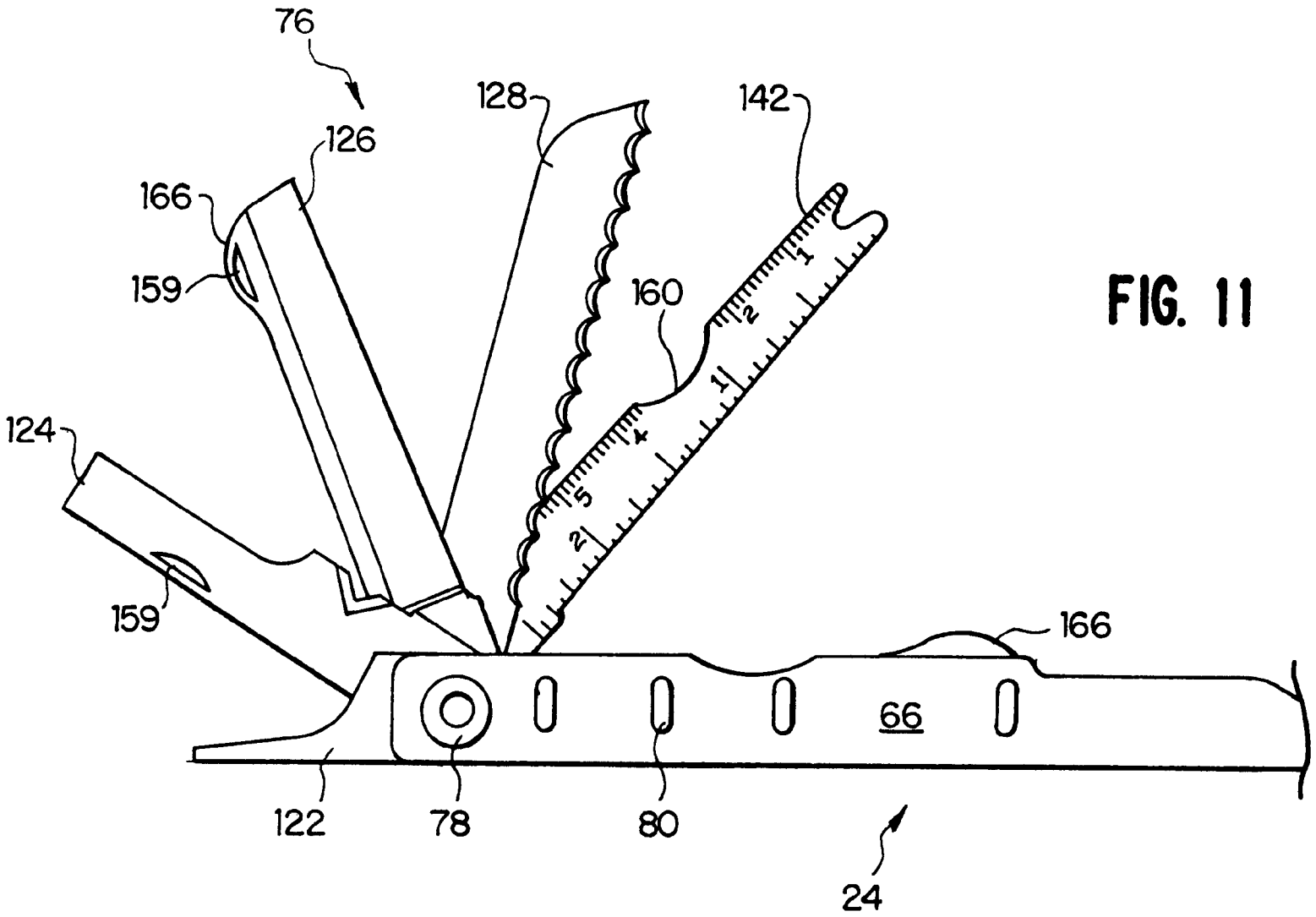
FIG. 11 is a reversed sectional side view of the other of the handles of the compound tool with the supplemental tools stored therein in varying degrees of extension.

Referring first to FIG. 10, a side view of a section of handle 22 is shown with five supplemental tools 76: a bottle/can opener 112, a Phillips head screwdriver 114, a scribe 116, a clip blade 118, and a file 120. FIG. 11 shows the other handle 24 with five additional tools: a small screwdriver 122, a combination large screwdriver/wire stripper 124, a scraper 126, a sheepfoot blade 128, and a ruler 142. The supplemental tools 76 have been rotated to varying degrees of extension to illustrate them better; they would not normally be used as shown. Normally, only one supplemental tool 76 would be extended at any given time. For example, when one needs to use Phillips head screwdriver 114, it would be extended alone (as shown in the lower portion of FIG. 8A). Tool 10 should be closed, as in FIG. 8A (note the location of nubs 80), to provide a hefty handle for the screwdriver.

Figure 8A:
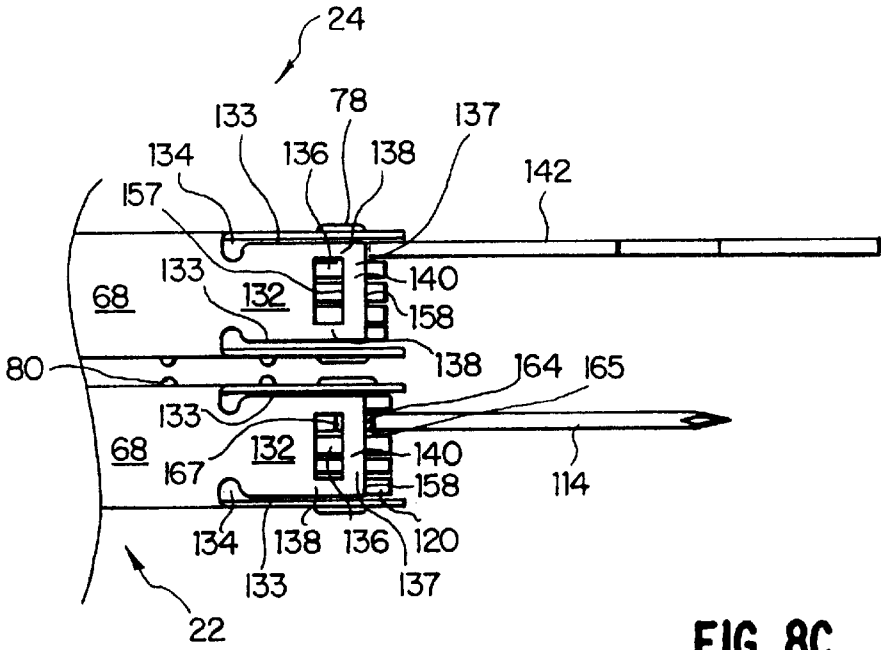
FIG. 8A is a sectional top view of the ends of the handles of the compound tool with two supplemental tools extended, showing the latching and locking mechanism in operation.

FIG. 8A is a partial top view of the ends of handles 22 and 24 intended to illustrate, along with FIGS. 8B, 8C, 9A and 9B, the operation of the latching and locking mechanism of the present invention. It should be understood that in FIG. 8A, both screwdriver 114 and ruler 142 are shown extended from their respective s handles 22 and 24; however, during actual use, only one such tool will be extended at any given time.

As shown in FIGS. 6 and 8A, webs 68 of handles 22 and 24 each include a resilient tongue 132 integral with and cantilevered from web 68. Tongue 132 is separated from sidewalls 64 and 66 by slits 133, and, being free from contact with handles 22 and 24 except where joined to web 68, tongue 132 comprises a leaf spring which is free to flex when deflected. A pair of recesses 134 inwardly and oppositely extend at the side junction between tongue 132 and web 68 to aid in the flexibility of tongue 132. A rectangular aperture or slot 136 is formed adjacent the free end 137 of tongue 132 and is bordered by two side strips 138 and a transverse stock 140. Stock 140 has an outer edge 158 defining the outer edge surface of free end 137, and an interior edge surface 157 defining the locking edge surface of slot 136. Flat tongue 132, flat stock 140, and flat web 68 are essentially coplanar when tongue 132 is in its at-rest, unflexed state. Compare FIGS. 10-11 where tongue 132 is at rest with FIGS. 9A-9B where tongue 132 has been deflected into its flexed state.

Ruler 142 (FIGS. 8A and 8B) is typical of a supplemental tool 76 mounted on pivot pin 78 outboard of the other tools in handle 24 and, therefore, in alignment with one of the side strips 138. File 120 is another such outboard mounted supplemental tool which is, however, located in the other handle 22. Ruler 142 (FIG. 8B) includes a tool body 144 and a mounting end 146. Tool body 144 is unique to the type of tool 76 included in compound tool 10 and includes whatever working surfaces are important to that particular tool. Mounting end 146 is constructed substantially the same as the mounting end of other outboard-mounted supplementary tools, such as file 120. Mounting end 146 includes an aperture 148 for receiving pivot pin 78 and a camming surface 150 having a first flat 152 formed adjacent a stop 154 and a second flat 156 positioned diametrically opposite to first flat 152. The radial width of camming surface 150 is slightly more than the distance between pivot pin 78 and tongue 132, whereas the radial width of flats 152 and 156 are substantially equal to that distance.

Figure 9A:
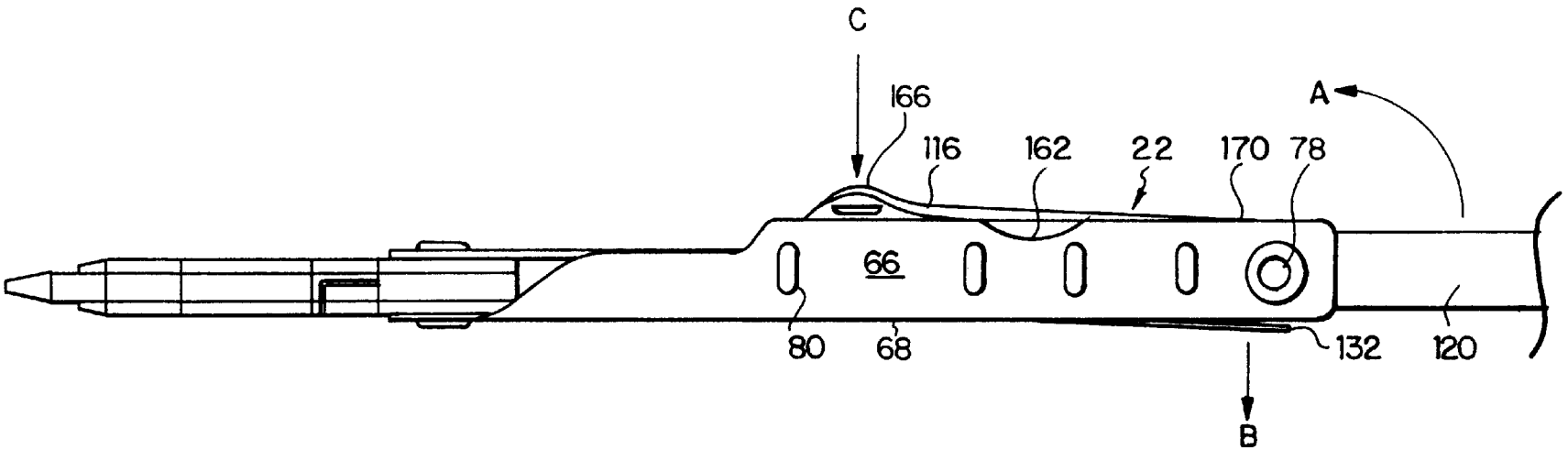
FIG. 9A is a side view of the compound tool illustrating the release of the latching mechanism.

In operation, when ruler 142 is in its fully extended position in longitudinal alignment with handle 24 (as shown in FIG. 8A, or when file 120 is in its fully extended position as shown in FIG. 9A), flat 152 is flush with the unflexed tongue 132, and stop 154 is in contact with outer edge 158 of stock 140. Stop 154 and edge 158 prevent ruler 142 (and any other similar supplemental tool such as file 120) from rotating beyond its alignment with handle 24. The flex-resisting force of tongue 132 urges stock 140 against flat 152 and thus biases ruler 142 and file 120 toward their fully extended positions, not preventing closure thereof but requiring an additional force be applied to overcome the bias. As such, ruler 142 and file 120 will be latched, as opposed to being positively locked (as some of the interior tools can be which will be described in greater detail shortly).

When in its closed position, housed within channel 70 of handle 22, file 120 is biased to its closed position by resilient tongue 132 pressing on flat 156, effectively holding file 120 in place. When being closed from its fully open position, as indicated by arrow A in FIG. 9A, camming surface 150 flexes tongue 132 (arrow B in FIG. 9A) slightly outwardly from the plane of web 68. If flats 152 and 156 were not of slightly less radial distance from pivot pin 78 than the remainder of camming surface 150, file 120 would not be held in its closed and extended positions, but rather would flop about uncontrollably.

File 120 and ruler 142 are merely illustrative of outboard mounted tools, or possibly an inboard mounted tool, which do not need to be positively locked in their open, extended positions. Clip blade 118 (FIG. 8C) is illustrative of an inboard mounted supplementary tool which needs for safety reasons to be positively locked in its open, extended position.

Clip blade 118 is shown having a body 144 appropriate to its function. Included in body 144 of clip blade 118 is a nail nick 159 to facilitate opening of clip blade 118. Some outboard tools, such as file 120 and ruler 142, have a notch 160 on their top edge when they are closed, to allow access to interior tools having nail nicks 159, such as bottle/can opener 112, scribe 116, clip blade 118, large screwdriver/wire stripper 124, and scraper 126. Handles 22 and 24 likewise include notches 162 (FIGS. 1, 9A and 10) for the same reason.

The mounting end 146 of clip blade 118 includes a pivot pin aperture 148, a camming surface 150, and a flat 156, all provided for the same purposes as described in connection with ruler 142. Mounting end 146 of clip blade 118 differs, however, from those of non-positively locked outboard tools in that in place of flat 152 and stop 154, mounting end 146 of clip blade 118 has a U-shaped locking transverse notch 164 located to mate with stock 140 of tongue 132.

As with all other supplemental tools 76, clip blade 118 is biased toward its closed position by tongue 132 acting upon flat 156. As clip blade 118 is rotated about pivot pin 78 (opposite to arrow A in FIG. 9A) to its open position, tongue 132 flexes (arrow B), because it is riding on the radially enlarged camming surface 150, until stock 140 snaps into U-shaped notch 164 of clip blade 118.

Figure 8C:
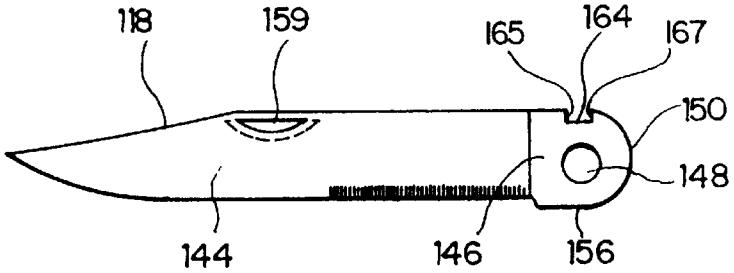
FIGS. 8B and 8C show side views of two supplemental tools.
Figure 8B:
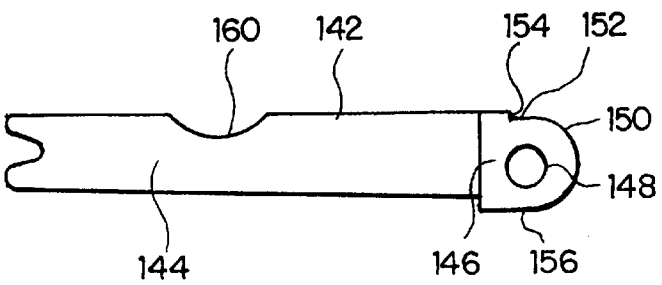

The width of aperture 136 (the smaller of its rectangular dimensions) must be large enough to enclose the portion of camming surface 150 that is located to the right of notch 164 as viewed in FIG. 8C in order to prevent the camming of stock 140 out of notch 164 by camming surface 150. Other than that, the dimensions of aperture 136 are not significant except for structural considerations.

The width of stock 140 (the smaller of its rectangular dimensions) is critical, however. It must be such that stock 140 fits snugly in notch 164. Stock 140 will remain in notch 164 until positively, forcibly removed. Before that occurs, therefore, clip blade 118 is positively locked in place. When tool 144 is in its extended open state, the upstanding edge surfaces 165 and 167 (FIGS. 8A and 8C) of U-shaped notch 164 abut edge surfaces 158 and 157, respectively, of stock 140. The coaction of edge surfaces 158 and 167 prevents rotation of tool 144 in one direction, thereby preventing tool 144 from opening beyond the desired extended position. The coaction of edge surfaces 157 and 165 prevents rotation of tool 144 in the other direction, thereby preventing tool 144 from unintentionally closing, i.e., leaving the desired extending position.

The locking mechanism described herein is a radical departure from prior art locking mechanisms, and has profound benefits associated therewith; as such it is an important feature of the present invention.

Bassett (U.S. Pat. No. 2,798,290) is representative of prior art patents which utilize a transverse slot or a leaf spring, but not both together, in the handle of a compound tool as part of a locking mechanism for tools. Bassett's knifeblade 41 has a detent lobe 28 on the peripheral surface of its mounting end. Locking of blade 41 is effected by a radially projecting, smoothly arcuate lobe 28 either "engaging slot 42 with detent action (FIGS. 6-7, and column 3, line 72 of Bassett) or being allowed to flex leaf spring 29 "to assume a position on spring 29 past dead center" (FIGS. 1–3, column 3, lines 30-31 of Bassett). In the former, lobe 28 includes an arcuate camming surface which bends the edges of slot 42 in fixed base 43, when lobe 28 is being placed therein or removed therefrom; there is no leaf spring involved. In the latter, there is no notch for lobe 28 to enter; leaf spring 29 merely provides a bias for an over-dead-center latch. In any event, a projection on mounting end 146 is not equivalent to a notch 164 being formed therein. Provision of a radial projection on the mounting end requires a reduction in the radial width of the annular ring surrounding the pivot pin which provides the structural support for the blade; a notch does not remove any material except to form the relatively small notch.

Prior art locking mechanisms which include a locking aperture in the housing inevitably include a projection on the blade to enter the locking aperture. Those members of the prior art which utilize a notch in the blade also traditionally provide a projection which fits in the notch to lock the blade, e.g., an L-shaped flange on the end of a separate element. Representative of this time-honored class, which are legion, are Barnard & Brace, U.S. Pat. No. 97,154, issued in November of 1869, and Evrell, U.S. Pat. No. 4,669,188. The addition of the extra locking element decreases the number of supplemental tools which can be housed in the tool while increasing the number of elements required for a functional tool and concomitantly the manufacturing costs.

A few patents, e.g., Hallvarson, U.S. Pat. No. 1,556,788, and Leatherman, U.S. Pat. Nos. 4,238,862 and 4,888,869, include a resilient spring on the housing with an L-shaped flange on the outer edge of the resilient spring to lock within a notch in the blade. This is in line with the conventional wisdom of the art, for it perpetuates the teachings of the prior art to include a projection for entering the notch.

Figure 9B:
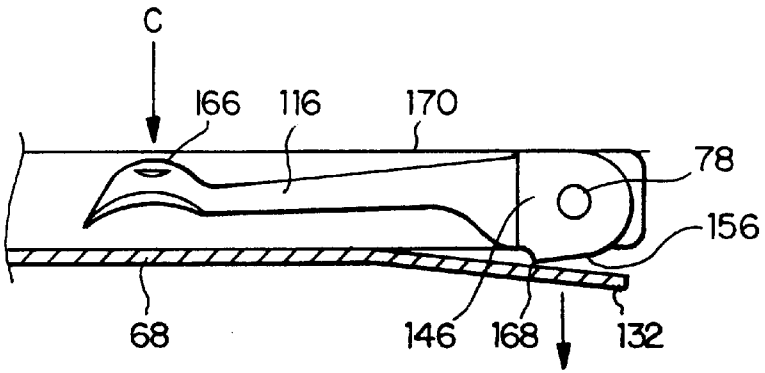
FIG. 9B is a cross-sectional side view of one of the supplemental tools releasing the locking mechanism.

Referring back to the present invention, the release means for the locking mechanism is illustrated in FIGS. 9A-9B. At least two of the supplemental tools 76, one in each handle, shown as scribe 116 in FIGS. 9A, 9B, and 10, and scraper 126 in FIG. 11, have a bulge 166 on their upper surfaces which protrudes above the open side edges 170 of sidewalls 64 and 66 when tools 76 are closed. Manual depression (arrows C, FIGS. 9A-9B) of bulge 166 rotates scribe 116 counter-clockwise (as viewed in FIGS. 9A-9B) about pivot pin 78, until the leading edge 168 of flat 156 depresses and deflects tongue 132 downwardly, thereby lifting stock 140 out of the notch 164 of an extended tool. This means of release does not necessarily need to be incorporated into a supplemental tool but would function equally as well as a single function release lever. The combination of a supplemental tool and a release lever into one component adds utility to the compound tool. By way of comparison with the prior art, Leatherman (U.S. Pat. No. 4,238,862; FIG. 6) shows a locking mechanism for a supplemental tool in which flange 90 on tongue 86 detents into notch 91 on the tool mounting end. Leatherman releases the lock by "partially opening one of the other tools on pivot pin 70 causing its cam surface 87 to retract the flange 90 out of notch 91" (column 7, lines 32–35). The instant invention constitutes a major improvement over this prior art by: (1) eliminating the flange, as discussed above; and (2) by depressing another tool rather than partially opening one. Depressing a tool, rather than partially opening it, has significant advantages. Depression of a closed tool requires no more than one hand squeezing the tool handle until bulge 166 descends below the open side edges 170 of sidewalls 64 and 66, where it will stop, keeping the tool within the handle. In contrast, partially opening a tool to release a locking mechanism (Leatherman) requires two hands, one to hold the handle and the other to grasp and lift the tool. As just alluded to, depressing the tool keeps it in the handle, out of the way, whereas opening a tool places it outside the handle where it is at least inconvenient and could be potentially dangerous (e.g., if it had a sharp point or edge).

An important feature of the present invention is the laminated construction of the plier jaws, illustrated in detail in FIGS. 14–17, where the same reference numerals used in FIGS. 12-13 identify the same features.

Figure 15:
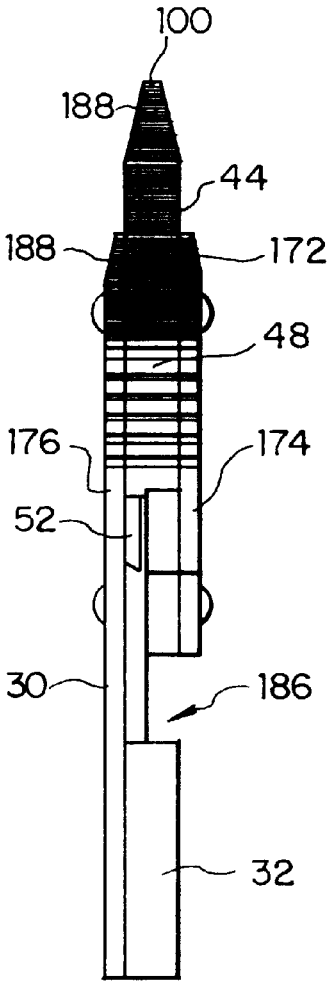
FIG. 15 is a side view of the jaw of FIG. 14 from the inside as seen along the lines 15—15 in FIG. 12.
Figure 16:
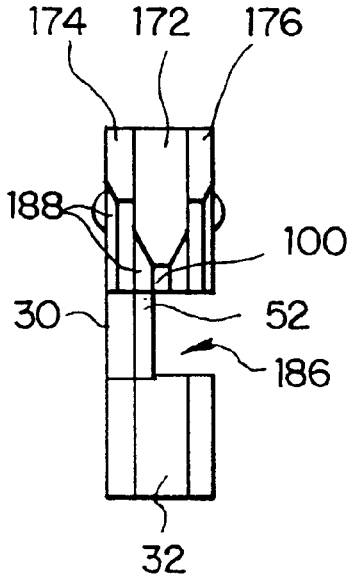
FIG. 16 is a front end view of the jaw of FIG. 14 as seen along the lines 16—16 in FIG. 12.
Figure 17:
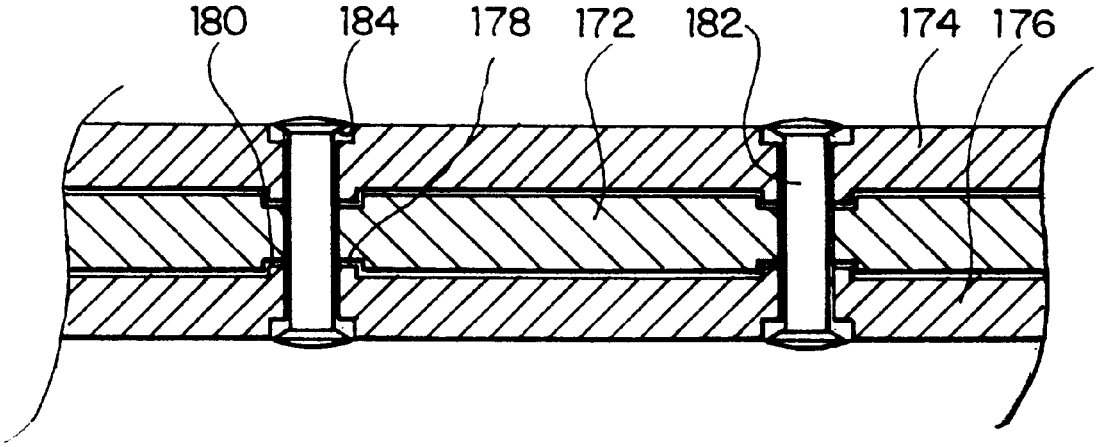
FIG. 17 is a sectional, cross-sectional view of the laminated structure of the plier jaws as seen along the lines 17—17 in FIG. 12.
Figure 18:
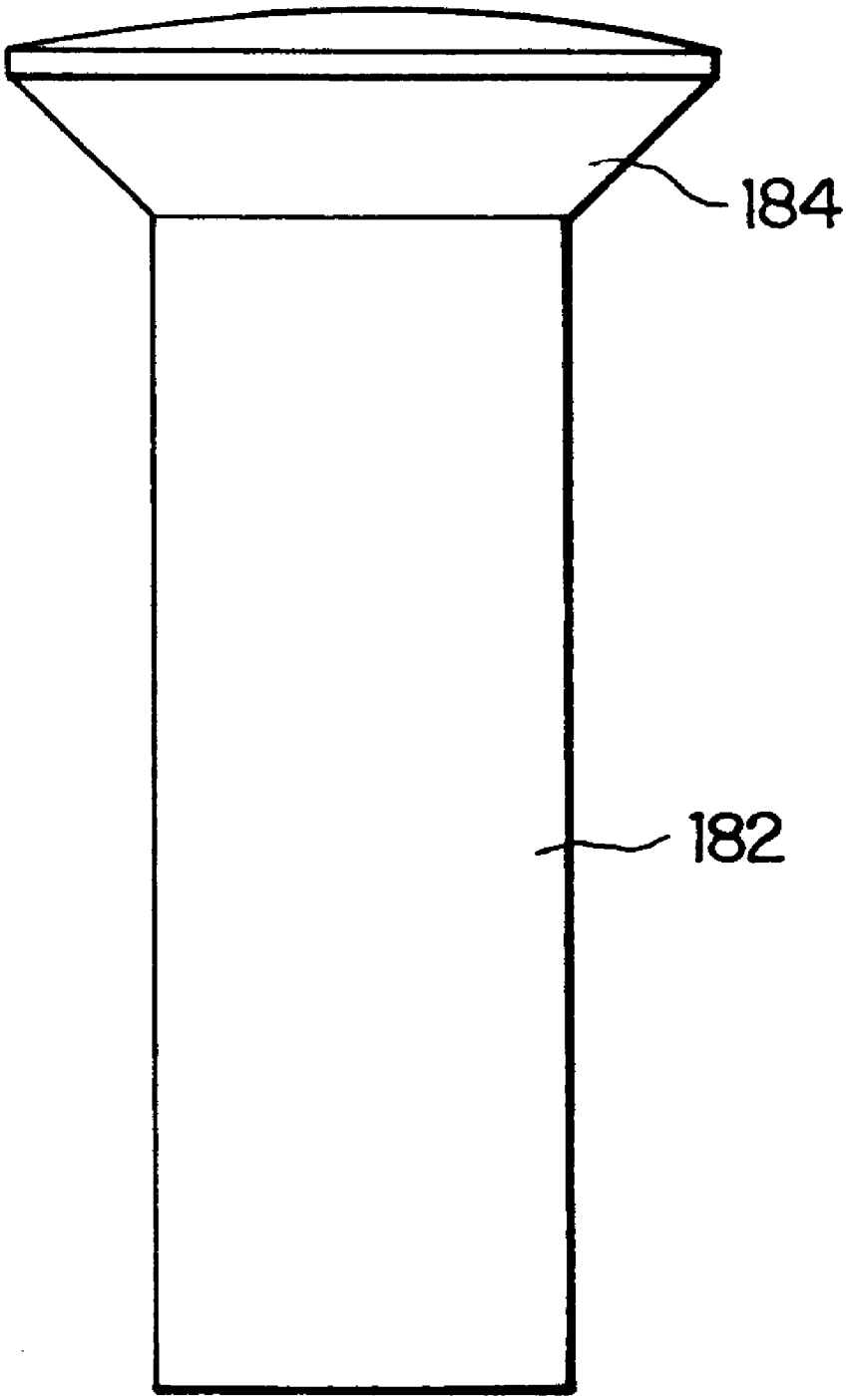
FIG. 18 is an enlarged side view of a preferred embodiment of a rivet used with the plier jaws of the present invention.

In FIGS. 14–17, jaw 18 is shown as comprising a central body 172 laminated with two outer strips 174 and 176. FIG. 17 is a sectional view of jaw 18 (taken along lines 17—17 of FIG. 12), wherein central body 172 and outer strips 174 and 176 are not shown to scale; in practice, central body 172 is much thicker than outer strips 174, 176, closer to the illustrations of FIGS. 14 and 15. As seen in FIG. 17, central body 172, being the heftier of the pieces, includes countersinks 178 which mate with daps 180 formed in outer strips 174 and 176. Countersinks 178 and daps 180 are preferably circular, but any convenient shape will do so long as they mate snugly. The countersink/dap combination prevents lateral sliding of the two outer strips relative to the central body and maintains the pieces in their relative orientations. Central body 172 and outer strips 174 and 176 can be secured together by any known means which is not detrimental to the use of pliers 12. A preferred method of securing the laminates (body 172 and outer strips 174 and 176) utilizes rivets 182, countersunk at 184 (FIG. 18), to provide added strength and to positively prevent separation of the laminates.

Figure 14:
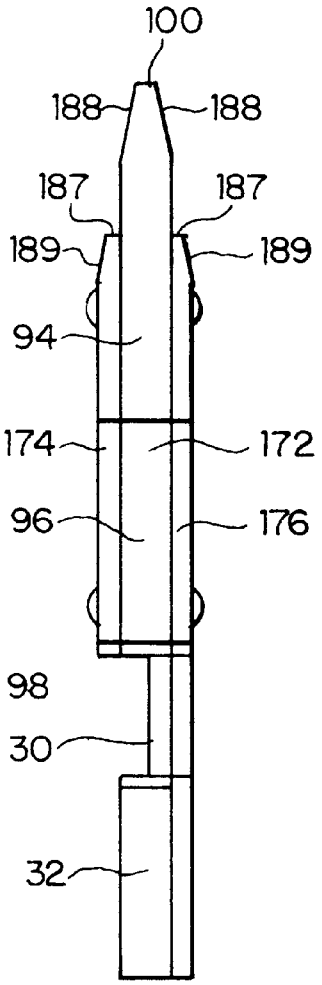
FIG. 14 is a side view of one of the jaws of the pliers from the outside as seen along the lines 14—14 in FIG. 12.

The laminated central body 172 and outer strips 174 and 176 are shaped as plier jaws as shown in FIGS. 14–16, jaw 20 being a mirror image of jaw 18, though some other shape, if advantageous, could be desirable. Central body 172 extends the full length of jaw 18 from tip 100 through bearing 32. Outer strip 176 extends similarly except that its forwardmost portion 187 does not extend as far as tip 100. Outer strip 174 terminates at its lower end at recess 186 adjacent bearing 30 which receives bearing 36 from jaw 20, when the two jaws are rotatably joined by pivot pin 26. The upper end of outer strip 174 terminates in a tip 187 that is the same as the uppermost tip of outer strip 176. Tip 100 of central body 172 is tapered on both sides thereof as at 188. Similarly, tips 187 of outer strips 174 and 176 are each tapered on both sides thereof as at 189. Taken together with the outer taper 94 of jaws 18 and 20 (FIGS. 12-13), the net effect is that jaws 18 and 20 comprise a pair of needlenose pliers. This needlenose effect is enhanced by having the tips 187 of outer strips 174 and 176 terminate rearwardly of tip 100, as previously described.

The laminated construction of plier jaws 12 as shown and described above is believed to be significantly stronger than non-laminated plier jaws.

It is clear from the above that the objects of the invention have been fulfilled.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the foregoing Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims.

We claim as our invention:

1. A multi-purpose tool foldable between an unfolded position and a folded position, comprising:

(a) a pliers having first and second crossed jaws and first and second handles, said first handle pivotally mounted to said first crossed jaw, said second handle pivotally mounted to said second crossed jaw;

(b) each of said first and second crossed jaws comprising:

(1) a gripping portion;

(2) a tip portion extending from said gripping portion;

(3) an outer surface;

(4) a jaw pivot bearing having a first axis;

(5) a tang;

(6) a tang pivot pin having a second axis and extending through said tang;

(7) said first and second crossed jaws being rotatably connected to each other through their respective jaw pivot bearings;

(c) each of said first and second handles comprising:

(1) a secured end and a free end;

(2) a handle pivot bearing at said secured end rotatably connected to a respective one of said tangs through its respective tang pivot pin;

(3) said first axis of said jaw pivot bearing and said second axis of said tang pivot pin of said first and second crossed jaws being substantially parallel to one another;

(4) an outboard wall facing away from the other handle when said tool is in said unfolded position and facing towards the other handle when said tool is in said folded position;

(5) an inwardly tapered portion along said outboard wall;

(d) said inwardly tapered portions of said outboard walls of said first and second handles forming a recess when said tool is in said folded position to at least partially enclose said jaws therebetween.

2. The multi-purpose tool of claim 1, wherein the shape of said inwardly tapered portion along said outboard wall is complementary to the shape of said outer surface of said crossed jaw.

3. The multi-purpose tool of claim 1, wherein said gripping portions of said first and second crossed jaws are unobstructed and accessible for use when said tool is in said folded position and said outboard walls at least partially enclose said jaws therebetween.

4. The multi-purpose tool of claim 1, wherein said outboard walls each include contact portions such that, when said tool is folded by pivoting said handles about said tang pivot pins, said contact portions of said outboard walls cam said tip portions of said jaws toward one another to assist in the folding of said multi-purpose tool.

5. The multi-purpose tool of claim 1, further comprising a plurality of supplemental tools mounted at said free end of at least one of said first and second handles, each of said supplemental tools being individually rotatable between a closed position within said handle and an open position extending from said handle.

6. The multi-purpose tool of claim 5, wherein each of said first and second handles includes a U-shaped channel within which said supplemental tools are adapted to be pivotally mounted.

7. The multi-purpose tool of claim 6, wherein each of said U-shaped channels comprises said outboard wall and a pair of additional walls extending therefrom to form said U-shaped channel.

8. The multi-purpose tool of claim 7, wherein said first and second handles define a plane and each of said U-shaped channels opens outwardly from said plane of said first and second handles.

9. The multi-purpose tool of claim 8, wherein each of said first and second handles further comprises a channel pivot pin journaled across said U-shaped channel adjacent said free end, the axis of said channel pivot pin being substantially orthogonal to said second axis of said tang pivot pins.

10. The multi-purpose tool of claim 1, wherein each of said crossed jaws comprises plural laminations and means for holding said plural laminations together.

11. The multi-purpose tool of claim 10, wherein said plural laminations include a mating countersink and dap.

12. The multi-purpose tool of claim 11, wherein said means comprises at least one rivet extending through said plural laminations.

13. The multi-purpose tool of claim 12, wherein said at least one rivet passes through said mating countersink and dap.

14. The multi-purpose tool of claim 11, wherein said plural laminations comprise a central body and a pair of outer strips, said countersink being formed in said central body and said dap being formed in said outer strips.

15. A multi-purpose folding tool which may be unfolded to form a pair of pliers and folded, comprising:

a pliers having a pair of crossed jaws, each of said jaws of said pliers comprising a gripping end with a tip, a jaw pivot bearing having a first axis, and a tang, said jaws being rotatably connected to each other through said jaw pivot bearings;

a pair of handles, each of said handles comprising:

a secured end and a free end, a tang pivot pin having a second axis and extending through said secured end of said handle and one of said tangs, aid first axis of said jaw pivot bearing and said second axis of said tang pivot pin being substantially parallel to one another;

a plurality of walls forming a U-shaped channel open along one side of said handle, said walls including a pair of parallel walls integrally connected by a third wall;

a channel pivot pin rotatable in said parallel walls transverse of said channel adjacent said free end of said handle;

a plurality of supplemental tools pivotally mounted on said channel pivot pin, each of said supplemental tools being individually rotatable between a closed position within said channel and an open position extending from said channel;

wherein, when said folding tool is unfolded to form a pair of pliers, one of said plurality of walls of each of said handles faces away from the other handle;

each of said handles including an inwardly tapered portion formed along said one of said plurality of walls; and wherein, when said folding tool is folded by pivoting said handles about said tang pivot pins, said inwardly tapered portions of said handles form a recess outside of said U-shaped channel, said recess at least partially enclosing said jaws therebetween.

16. The multi-purpose folding tool of claim 30, wherein said one of said plurality of walls of each of said handles comprises said third wall.

17. The multi-purpose folding tool of claim 16, wherein one of said plurality of walls of each of said handles include contact portions so that, when said folding tool is folded by pivoting said handles about said tang pivot pins, said contact portions coact with said tips of said jaws to facilitate folding thereof.

18. The multi-purpose tool of claim 15, further comprising a plurality of supplemental tools pivotally mounted in at least one of each of said handles within said U-shaped channel thereof.

19. The multi-purpose tool of claim 18, wherein said pair of handles define a plane and said U-shaped channel opens outwardly from said plane of said handles.

20. The multi-purpose tool of claim 15, wherein said channel pivot pin has a third axis which is substantially orthogonal to said second axis of said tang pivot pin.

21. A jaw for a gripping tool, comprising:

a central body including a central gripping end, a pivot bearing, and a tang;

a first outer strip including a first gripping end; and a second outer strip including a second gripping end;

said central gripping end, said first gripping end, and said second gripping end being in aligned, overlapping relationship;

said pivot bearing having pivot means extending therethrough for enabling two of said jaws to be pivotally mounted thereat;

said central body including at least one countersink facing each of said outer strips, and each of said outer strips including at least one dap mating with said facing countersink; and a rivet passing through each of said mating countersinks and daps for securing said central body and said outer strips together.

22. A jaw for a gripping tool as in claim 21, wherein said gripping end of said central body includes a flat gripping surface, an arcuate gripping surface, and a wire cutting blade.

23. A jaw for a gripping tool as in claim 22, wherein said gripping end of said first and second outer strips include a flat gripping surface and an arcuate gripping surface.

24. A jaw for a gripping tool as in claim 23, wherein said gripping surfaces are serrated.

25. A gripping tool, comprising:

a pair of crossed jaws, each of said jaws comprising at least two laminated sheets, said laminated sheets being reinforced with at least one mating countersink and dap;

a rivet passing through said at least one mating countersink and dap; and handles for forcing said jaws together to grip an object.

26. The gripping tool of claim 25 wherein said laminated sheets comprise a central body and a pair of outer strips, said countersinks being formed in said central body and said daps being formed in said outer strips.

27. A folding tool which may be moved between an unfolded position where it is usable as a pair of pliers and a folded position, comprising:

(a) a pliers having a pair of crossed jaws and first and second handles, (b) each of said pair of crossed jaws comprising a gripping portion, a tip portion, a tang, and an outer surface;

(c) said pair of crossed jaws being rotatably coupled to each other about a main jaw pivot axis;

(d) each of said first and second handles comprising a secured end and a free end, said secured end of said first handle being pivotally coupled to one of said tangs of said pair of crossed jaws to define a first handle pivot axis, said secured end of said second handle being pivotally coupled to the other of said tangs of said pair of crossed jaws to define a second handle pivot axis;

(e) each of said first and second handles further including an outboard wall, said outboard wall of said first handle facing away from said outboard wall of said second handle when said tool is in said unfolded position, said outboard wall of said first handle facing towards said outboard wall of said second handle when said tool is in said folded position;

(f) each of said first and second handles including an inwardly tapered portion along said outboard wall;

(g) said inwardly tapered portions of said outboard walls of said first and second handles forming a recess when said tool is in said folded position to at least partially enclose said jaws therebetween.

28. The folding tool of claim 27, wherein the shape of said inwardly tapered portion along said outboard wall is complementary to the shape of said outer surface of said crossed jaw.

29. The folding tool of claim 27 wherein said gripping portions of said first and second crossed jaws are unobstructed and accessible for use when said tool is in said folded position and said outboard walls at least partially enclose said jaws therebetween.

30. The folding tool of claim 27, wherein said outboard walls each further include contact portions such that, when said tool is folded by pivoting said handles about said first and second handle pivot axes, said contact portions of said outboard walls cam said tip portions of said jaws toward one another to assist in the folding of said tool.

31. The folding tool of claim 27, wherein said free end of at least one of said first and second handles further comprises at least one supplemental tool.

32. The folding tool of claim 27, wherein said free ends of both of said first and second handles further comprises supplemental tools.

33. The folding tool of claim 27, wherein said main jaw pivot axis, said first handle pivot axis and said second handle pivot axis are all substantially parallel to one another.

34. The folding tool of claim 27, further comprising a plurality of supplemental tools mounted at said free end of at least one of said first and second handles, each of said supplemental tools being individually rotatable between a closed position within said handle and an open position extending from said handle.

35. The folding tool of claim 34, wherein said at least one of said first and second handles includes a U-shaped channel within which said supplemental tools are adapted to be pivotally mounted.

36. The folding tool of claim 35, wherein said U-shaped channel comprises said outboard wall and a pair of additional walls extending therefrom to form said U-shaped channel.

37. The folding tool of claim 36, wherein said first and second handles define a plane and said U-shaped channel opens outwardly from said plane of said first and second handles.

38. The folding tool of claim 37, wherein each of said first and second handles further comprises a channel pivot pin journaled across said U-shaped channel adjacent said free end, said channel pivot pin having a pivot pin axis that is substantially orthogonal to said first and second handle pivot axes.

39. The folding tool of claim 27, wherein each of said crossed jaws comprises plural laminations and means for holding said plural laminations together.

40. The folding tool of claim 39, wherein said plural laminations include a mating countersink and dap and said means for holding comprises at least one rivet extending through said plural laminations.

41. The folding tool of claim 40, wherein said at least one rivet passes through said mating countersink and dap, and wherein said plural laminations comprise a central body and a pair of outer strips, said countersink being formed in said central body and said dap being formed in said outer strips.

42. A folding tool which may be moved between an unfolded position where it is usable as a pair of pliers and a fully folded position, comprising:

(a) a pliers having a pair of crossed jaws and a pair of handles, (b) each of said pair of crossed jaws comprising a top surface, a bottom surface, an inner gripping portion formed between said top and bottom surfaces, and an outer surface formed between said top and bottom surfaces;

(c) said pair of crossed jaws being rotatably coupled to each other about a jaw pivot axis;

(d) each of said pair of handles comprising a secured end, a free end, and a recessed portion located between said secured end and said free end, said secured end of one handle being pivotally coupled to one of said pair of crossed jaws to form one pivot axis, said secured end of the other handle being pivotally coupled to the other of said pair of crossed jaws to form another pivot axis, said pair of handles being pivotally rotated with respect to said crossed jaws about said one pivot axis and said another pivot axis when said tool is moved between said fully folded and unfolded positions;

(e) wherein, when said tool is in said unfolded position, said recessed portions of said pair of handles comprise hand grip portions adapted to be gripped by a user; and (f) wherein, when said tool is in said fully folded position, said recessed portions of said pair of handles are adjacent said outer surfaces of said pair of crossed jaws whereby neither of said handles obstruct any substantial portion of said inner gripping portion and said top and bottom surfaces of said jaws.

43. The folding tool of claim 42, wherein said jaw pivot axis is parallel to said one pivot axis and said another pivot axis.

44. The folding tool of claim 42, wherein the shape of said recessed portion is complimentary to the shape of said outer surface of said crossed jaw.

45. The folding tool of claim 42, further comprising a plurality of supplemental tools adapted to be mounted to said pair of handles, each of said supplemental tools being individually rotatable between a closed position on said handle and an open position extending from said handle.

46. The folding tool of claim 45, wherein each of said pair of handles includes a U-shaped channel within which said supplemental tools are adapted to be pivotally mounted.

47. The folding tool of claim 46, wherein each of said U-shaped channels comprises an outboard wall that includes said recessed portion and a pair of additional walls extending therefrom to form said U-shaped channel.

48. A folding tool which may be moved between an unfolded position where it is usable as a pair of pliers and a folded position, comprising:

(a) a pliers having a pair of crossed jaws and first and second handles, (b) each of said pair of crossed jaws comprising an inner gripping portion, a tip portion, a tang, and an outer surface;

(c) said pair of crossed jaws being rotatably coupled to each other about a main jaw pivot axis to enable movement between an open position where said tip portions are separated from each other and a closed position where said tip portions touch each other;

(d) each of said first and second handles comprising a secured end and a free end, said secured end of said first handle being pivotally coupled to one of said tangs of said pair of crossed jaws to define a first handle pivot axis, said secured end of said second handle being pivotally coupled to the other of said tangs of said pair of crossed jaws to define a second handle pivot axis;

(e) each of said first and second handles further including an outboard wall, said outboard wall of said first handle facing away from said outboard wall of said second handle when said tool is in said unfolded position, said outboard wall of said first handle facing towards said outboard wall of said second handle when said tool is in said folded position;

(f) wherein, when said tool is in said unfolded position, said outboard walls of said pair of handles comprise hand grip portions adapted to be gripped by a user; and (g) wherein, when said tool is in said folded position and said pair of crossed jaws are substantially in said closed position, said outboard walls of said pair of handles are adjacent said outer surfaces of said pair of crossed jaws whereby neither of said handles obstruct any substantial portion of said inner gripping portions of said jaws.

49. The folding tool of claim 48, wherein said jaw pivot axis is parallel to said first handle pivot axis and said second handle pivot axis.

50. The folding tool of claim 48, further comprising a plurality of supplemental tools adapted to be mounted to said first and second handles, each of said supplemental tools being individually rotatable between a closed position on said handle and an open position extending from said handle.

51. The folding tool of claim 50, wherein each of said pair of handles includes a U-shaped channel within which said supplemental tools are adapted to be pivotally mounted.

52. The folding tool of claim 51, wherein each of said U-shaped channels comprises said outboard wall and a pair of additional walls extending therefrom to form said U-shaped channel.

53. The folding tool of claim 52, wherein said outboard walls further include a recessed portion adapted to be gripped by a user when said tool is in said unfolded position and adapted to be adjacent said outer surface when said tool is in said folded position.

54. The folding tool of claim 53, wherein the shape of said recessed portion is complimentary to the shape of said outer surface.

* * * * *